US007498932B1

(12) United States Patent
Steffen

(10) Patent No.: US 7,498,932 B1
(45) Date of Patent: Mar. 3, 2009

(54) OIL LEVEL MONITORING SYSTEM FOR AN INTERNAL COMBUSTION ENGINE

(75) Inventor: Michael Steffen, München (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/598,474

(22) PCT Filed: Apr. 29, 2005

(86) PCT No.: PCT/EP2005/004675

§ 371 (c)(1),
(2), (4) Date: Jun. 28, 2007

(87) PCT Pub. No.: WO2005/106216

PCT Pub. Date: Nov. 10, 2005

(30) Foreign Application Priority Data

Apr. 30, 2004 (DE) ..... 10 2004 021 394

(51) Int. Cl.
*B60Q 1/00* (2006.01)

(52) U.S. Cl. ..... 340/450.3; 340/450; 340/438; 340/457.4; 123/73 AD; 123/196 R; 123/196 S; 184/6.3; 184/6.4

(58) Field of Classification Search ..... 340/450.3, 340/450, 438, 457.4; 73/117.3; 123/73 AD, 123/196 R, 196 S; 404/117, 102, 122; 29/428, 29/898.07; 184/6.1, 6.2, 6.3, 6.4, 6.5
See application file for complete search history.

(56) References Cited

U.S. PATENT DOCUMENTS

| | | | | |
|---|---|---|---|---|
| 4,213,337 | A | 7/1980 | Langdon | |
| 4,306,525 | A | 12/1981 | Faxvog et al. | |
| 4,385,290 | A | 5/1983 | Fiala et al. | |
| 4,429,670 | A * | 2/1984 | Ulanet | 123/198 D |
| 4,503,419 | A | 3/1985 | Kidd et al. | |
| 4,648,364 | A | 3/1987 | Wills | |
| 4,684,917 | A | 8/1987 | Tharman | |
| 4,771,746 | A | 9/1988 | Kobayashi et al. | |
| 4,876,529 | A | 10/1989 | Kubota et al. | |
| 4,890,695 | A | 1/1990 | Morris et al. | |
| 5,117,218 | A | 5/1992 | Sasaki et al. | |

(Continued)

FOREIGN PATENT DOCUMENTS

| | | | |
|---|---|---|---|
| EP | 0416688 | A | 3/1991 |

(Continued)

OTHER PUBLICATIONS

U.S. Appl. No. 11/623,138, filed Jan. 15, 2007, entitled "Capacitance-Based Fluid Level Sensor," to Ketelhohn et al.

*Primary Examiner*—Jeffery Hofsass
*Assistant Examiner*—Sisay Yacob
(74) *Attorney, Agent, or Firm*—Boyle Fredrickson, S.C.

(57) ABSTRACT

An internal combustion engine in a working device comprises an oil reservoir near a crankcase to hold oil. An oil measurement device is used to recognize the existence of oil in the oil reservoir and to produce a corresponding signal that is evaluated in an evaluation device to produce an oil level reading. The oil level reading is preferred to be produced only during the starting of the internal combustion engine or within a specific time period after starting the internal combustion engine. When the internal combustion engine has reached its operating RPM, no further oil level monitoring is performed.

35 Claims, 3 Drawing Sheets

U.S. PATENT DOCUMENTS

| | | | | |
|---|---|---|---|---|
| 5,654,546 | A | 8/1997 | Lindsay | |
| 5,687,687 | A | 11/1997 | Trueblood et al. | |
| 5,861,811 | A | 1/1999 | Lease et al. | |
| 6,040,767 | A | 3/2000 | Dykstra | |
| 6,443,006 | B1 | 9/2002 | Degrave | |
| 6,580,366 | B1 | 6/2003 | Engfehr | |
| 6,701,784 | B1 | 3/2004 | Matusek et al. | |
| 6,791,334 | B2 | 9/2004 | Horie et al. | |
| 6,994,059 | B2 * | 2/2006 | Greppmair | 123/73 AD |
| 2003/0233875 | A1 | 12/2003 | Stehman et al. | |
| 2004/0005191 | A1 * | 1/2004 | Geier et al. | 404/117 |
| 2005/0093369 | A1 | 5/2005 | Iida et al. | |

FOREIGN PATENT DOCUMENTS

| | | | |
|---|---|---|---|
| JP | 5514970 | A | 11/1980 |
| JP | 2004150374 | | 5/2004 |

* cited by examiner

OIL LEVEL MONITORING SYSTEM FOR AN INTERNAL COMBUSTION ENGINE

BACKGROUND OF THE INVENTION

1. Field of the Invention

The invention pertains to a working device according to the preamble of patent claim 1 that contains an internal combustion engine, and to a method of monitoring an oil level in a combustion engine according to the preamble of patent claim 24.

2. Description of the Related Art

Internal combustion engines, in particular four-cylinder gas or diesel engines, require a sufficient supply of oil in order for the lubrication to function properly. This oil supply is provided by oil contained in an oil reservoir. The oil reservoir is usually located in the vicinity of a crankcase so that the oil is distributed to the points of lubrication of the cylinders, pistons, bearings, etc. through sling lubrication, or by means of an additional oil pump.

In such systems, the presence of an amount of oil required for engine lubrication is verified using an oil dipstick, for example, or using various sensors (e.g. oil pressure switches in the case of lubrication using oil pumps). The sensors can be used in a monitoring circuit such that they shut off the engine if a lack of oil is detected, or such that they indicate the lack of oil via control lamps or similar devices. Engines without oil pumps usually have dipsticks or sight glasses.

Simple equipment for the purpose of oil monitoring also consist of a float that measures the oil level wherein the ignition system of the internal combustion engine is interrupted when there is a lack of oil. In this case, the engine does not start at all with a low oil level. For high-vibration machines and uncontrolled turbulent oil motion in the engine, the engine can also shut off even if there is sufficient oil present. Since the oil is tossed around, the float assumes a position that represents a lack of oil such that the corresponding actions are taken and the engine is shut off.

Since the known monitoring systems prevent the internal combustion engine from starting at all when a low oil level is determined—as illustrated above—, the operator of the equipment cannot know why the engine will not start. Consequently, he may take inappropriate or unnecessary actions to return the equipment to operation (replacement of spark plugs, cleaning the carburetor, etc.).

Many working devices include an internal combustion engine as well as a vibration exciter that is driven by the internal combustion engine. Possible working devices include: tampers for soil compaction, vibration plates, hammers, etc. Based on the strong vibration produced by the vibration exciter, the oil in the internal combustion engine is heavily circulated. Accordingly, it is difficult to determine, using known oil monitoring systems, whether enough oil is available for lubrication of the internal combustion engine.

In U.S. Pat. No. 6,560,366 B1, a system to determine the chemical modification of oil in an automobile is described. One element of the system is an oil level measurement device. Based on the change in the amount of oil, the change in the chemical composition of the oil is determined. In order to attain the required measurement precision, the oil amount is determined prior to the start of the machine using an oil measurement sensor.

From U.S. Pat. No. 4,306,525, an oil display is known in which a visual oil sensor is provided at an oil recycle line in an internal combustion engine. The measurement and display of the oil level is determined immediately after closing a key-operated switch, i.e. prior to starting the internal combustion engine.

OBJECT OF THE INVENTION

The object of the invention is to provide a working device with an internal combustion engine in which a reading as to the oil level can be reliably obtained. Another object is to provide a method to monitor an oil level in an internal combustion engine.

These objects are accomplished according to the invention by means of a working device according to claim 1 and according to methods according to claims 23 and 24.

The working device according to the invention comprises an oil measurement device to recognize that oil is present in the oil reservoir and to produce a corresponding signal. Furthermore, an evaluation unit to produce an oil level reading based on the signal from the oil measurement device is provided. The oil level reading can be produced within a specific time frame after starting the internal combustion engine, wherein the oil level reading remains even after the start of the internal combustion engine an/or after the specific time period after start has elapsed.

Since it is extremely difficult to determine the oil level in an internal combustion engine during operation, especially when the engine contains an oil reservoir (oil sump) but no oil pump because the oil is thrown about inside the crankcase of the internal combustion engine, the oil level reading is determined at a point in time at which the oil is still largely at rest, i.e. is still located in the oil reservoir due to gravity. As soon as the internal combustion engine has reached its full operating RPM and/or when the specified time period has elapsed, the oil level monitoring system can no longer be relied upon, especially if the internal combustion engine drives a vibration exciter contained within the working device. According to the invention, the monitoring system can continue to operate, but it should not be considered reliable at that point.

The theory behind the invention is that the oil level reading is determined at a point in time when the oil measurement equipment can still provide reliable measurement results, with the oil level reading still being available at a later time point at which the oil measurement system is no longer expected to provide reliable measurement results, i.e. during the intended operation of the working device. The oil level reading in this context can be issued as an evaluated measurement value or a correspondingly prepared signal that represents whether or not enough oil is present in the oil reservoir.

Specific consequences can be introduced based on the oil level reading, as explained below.

Simply stated, the measurement of the oil level during starting (prior to, during or shortly thereafter) is thus performed at a point in time when the working device is at relative rest.

The oil level reading produced according to the invention, which is a criterion and still available even at a later time point, does not preclude the collection of oil level readings at a later time point, i.e. during operation of the working device. However, these oil level readings are either not sufficiently reliable or are evaluated according to other criteria not covered here in more detail since they are not part of the invention. What is a criterion for the invention is the early determination of an oil level reading.

In connection with the starting of the internal combustion engine, the beginning of the starting process is determined as the point when a crankshaft of the internal combustion engine begins to rotate. The end of the starting process is determined as a time point when the RPM of the crankshaft is larger than a starting RPM generated by a crankshaft starting device (e.g. an electric starter or a reversing starter). This is the point at which the internal combustion engine is able to increase its crankshaft RPM by itself without requiring further support from the starting device.

What is particularly advantageous is if the specific time period after the start of the internal combustion engine is short relative to the total operating period of the internal combustion engine after starting. If one assumes that the internal combustion engine has been operating for at least a few minutes, the predetermined time period should be in the range of a few seconds. In particular, the time period within which the oil level reading is to be determined should end before the vibration exciter is activated by the internal combustion engine.

The oil level reading is determined by the evaluation device using the signal from the oil measurement device. Essentially, the oil level reading will indicate that sufficient oil exists in the oil reservoir or that there is a lack of oil.

If the working device contains a vibration exciter, the beginning of operation of the vibration exciter by the internal combustion engine can signal the end of the "specific time period". This means that the oil level reading can be determined up until the vibration exciter is activated. However, the vibration exciter will exert vibrations upon the working device that are so strong that thereafter, i.e. during normal operation of the device, reliable oil level monitoring is no longer possible.

In another embodiment of the invention, the oil level reading can be produced up to the point at which the clutch couples the internal combustion engine to the vibration exciter. This ensures that the strong vibrations of the vibration exciter can no longer affect the oil level reading being produced.

In yet another embodiment of the invention, the oil level reading can be produced when the internal combustion engine has reached a predetermined minimum RPM after it has been started. For example, the minimum RPM can be selected to be relatively low as required to produce a supply of power for the oil measurement device and the evaluation device with the aid of corresponding systems in the internal combustion engine. Since an internal combustion engine usually reaches at least an idle RPM relatively quickly after being started, and sometimes even an operating RPM that is greater than this, the time period during which the oil level reading is produced is very short.

In an advantageous further development of the invention, the oil level reading can be produced as long as the starting crankshaft RPM is less than a predetermined working RPM at which the working device is performing its work as intended.

It is especially advantageous if the oil level reading at the beginning of an operating period of the internal combustion engine, i.e. during or after starting in particular, is produced once. This means that the oil level is determined, or the existence of oil is established and evaluated in the form of an oil level reading, at a specific and particularly suitable time point at which there must still be a relatively large amount of oil in the oil reservoir. If the oil level is OK, i.e. there is oil present, no further actions are required during the operating cycle. This particularly applies if the internal combustion engine has a relatively short operating period until it is stopped again. When the internal combustion engine is restarted, the oil level is checked again.

If, on the other hand, the oil level reading indicates that there is not enough oil in the oil reservoir, the internal combustion engine can be shut off using a stopping device. A suitable stopping device can include the ignition system of the engine, for example, which is controlled by the evaluation device in a manner suitable for shutting off the engine.

However, it is not absolutely necessary to immediately shut off the engine after detecting a lack of oil followed by the production of an oil level reading. To the contrary, there can be a period of time that elapses before the stopping device shuts off the internal combustion engine after determining the oil level. The advantage to this is that the operator can obtain other related information indicating to him that there is a lack of oil, such as acoustical or optical warnings.

In another embodiment of the invention, the evaluation device is coupled to an RPM regulating device such that the RPM of the internal combustion engine can be adjusted to an RPM that is below an operating RPM, such as an idle RPM, when an oil level reading is present indicating a lack of oil. Normally, the internal combustion engine can be operated during idle for a relatively long period even with a lack of lubrication without damaging it. Here, as well, the operator can acquire related information so that he can see that there is a lack of oil.

The acoustic warning and, primarily, the optical warning can be issued during a specific time period even if the oil level reading is no longer present. For example, it is possible for the internal combustion engine to be shut off by one of the actions described above or by an operator's intervention. In this case, it could be helpful if an LED continues to be energized over a specific time period as an optical warning, for example. It may be required to provide a suitably configured capacitor device as a source of energy for this.

In a preferred embodiment of the invention, the internal combustion engine includes a power device to produce and/or store electrical energy. This power device can be an alternator system to produce electrical energy or it can be a battery ignition system that stores electrical energy. The power device provides the required power supply for the oil measurement device and the evaluation device. For an alternator system in particular, the power supply is produced only when the internal combustion engine is started, i.e. when the crankshaft is rotated. The oil level reading is then always producible right after the starting process begins. In this case as well, a relatively short time period should be maintained.

If the oil level reading is to be acquired prior to the start of the internal combustion engine, it is especially advantageous if a power supply device that stores electrical energy is provided to supply power to the oil measurement device and to the evaluation device. The oil level reading can then also be stored as necessary with the aid of this electrical energy.

It is preferable that the evaluation device be integrated into the oil measurement device so that the two components form a single unit and can be installed in the internal combustion engine at the same time.

An oil sensor provided in the oil measurement device can be operated according to many principles; particularly suitable are capacitive, optical, thermal and/or mechanical measurement principles.

It is especially advantageous if the oil sensor, if necessary together with its integrated evaluation device, can be screwed into an engine housing of the internal combustion engine. A hole can be used for this purpose, such as the original hole that was used for a dipstick.

A method according to the invention comprises the following steps: first, the internal combustion engine is started using the starter device (electrical starter or reversing starter). Directly after the beginning of the starting process of the internal combustion engine, the oil measurement device is operated in such a way that the presence of oil in the oil reservoir can be recognized and a corresponding signal can be produced. The signal is evaluated in order to produce an oil level reading that provides an indication as to whether or not enough oil is present in the internal combustion engine.

The oil level reading remains even after the starting phase has finished, and can be used to introduce appropriate consequences.

It is preferable for the oil level reading to be produced only after a pre-determined minimum RPM of the internal combustion engine as been reached.

If the oil level reading corresponds to a reading of too little oil in the oil reservoir, various actions can be initiated: the operation of the internal combustion engine can be immediately interrupted, or else after a predetermined period of time has elapsed after determining that there is a lack of oil. It is also possible to limit the RPM of the internal combustion engine to an RPM value below an operating RPM. Alternatively, or in addition to this, acoustic and/or optical warnings can be conveyed to the operator.

These and other advantageous and features of the invention are described in more detail below with the help of an example and with reference to the accompanying figures. Shown are:

DETAILED DESCRIPTION OF THE PREFERRED EMBODIMENT

Figure 1:
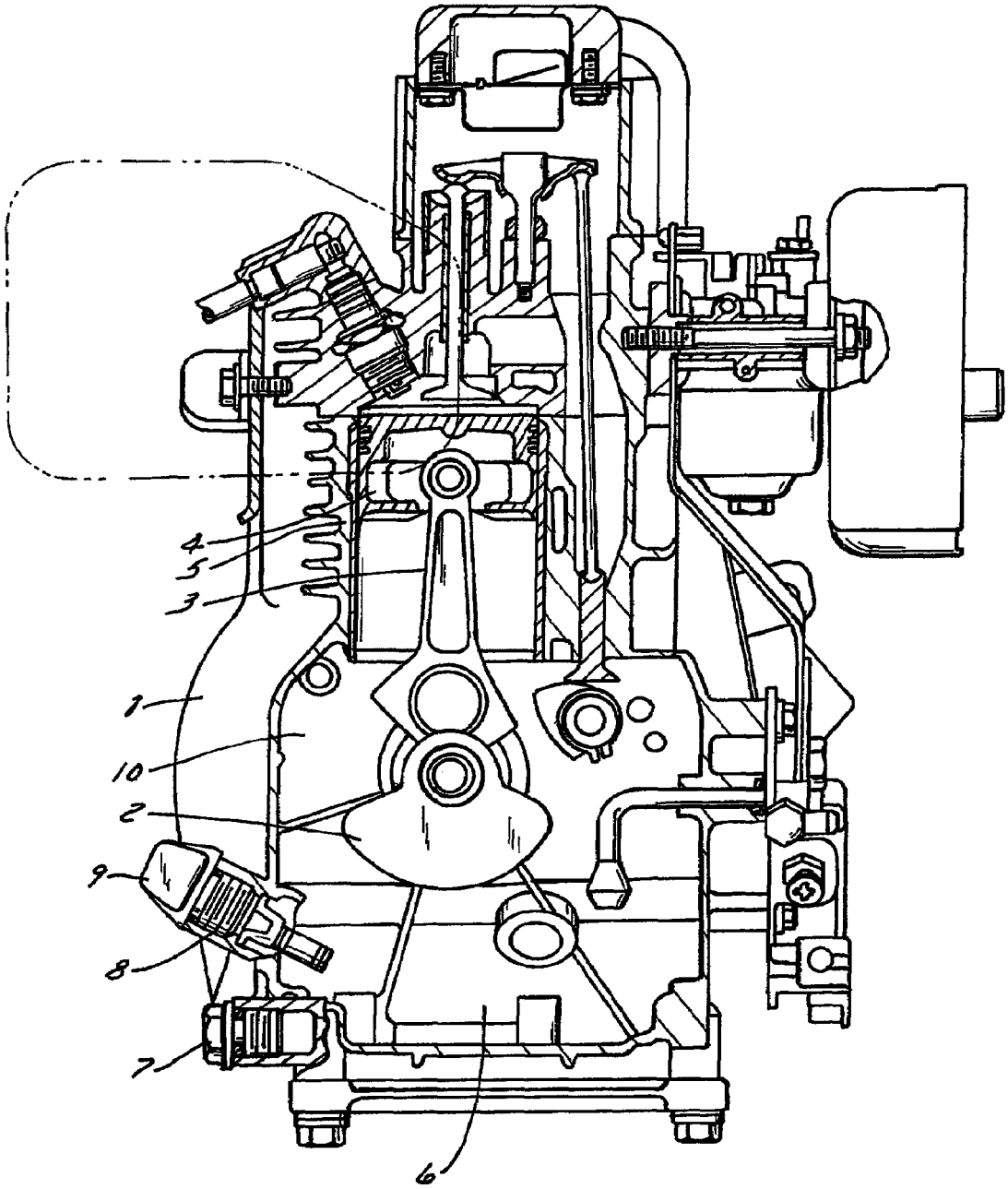
FIG. 1 a schematic representation of a known internal combustion engine.

In FIG. 1, a known internal combustion engine is shown so that only a short description is given below. Basic internal combustion engines include engines with separated lubrication such as four-cylinder gasoline or diesel engines.

A crankshaft 2 is rotatably held in an engine housing 1, and at least one connecting rod 3 is rotatably held at the crankshaft. At the other end of the connecting rod 3 is a piston 4 that moves back and forth axially inside a cylinder 5. Below the crankshaft is an oil reservoir 6 (oil pan, oil sump) where lubricating oil is collected. The oil can be drained via an oil outlet 7 if the oil becomes dirty or decomposed.

In the internal combustion engine shown in FIG. 1, a static oil pressure switch 9 is placed in a threaded socket 8 provided in the engine housing 1. The oil pressure switch 9 has the disadvantage in that it functions in principle like a float such that it can no longer reliably determine the presence of a sufficient amount of oil while the internal combustion engine is operating, particularly when the internal combustion engine drives a vibration exciter, which is not shown, thereby very vigorously tossing the oil about inside a crankcase 10 surrounding the crankshaft 2. This results in the possibility of the oil pressure switch 9 detecting a lack of oil even though sufficient oil is circulating inside the crankcase 10.

Figure 2:
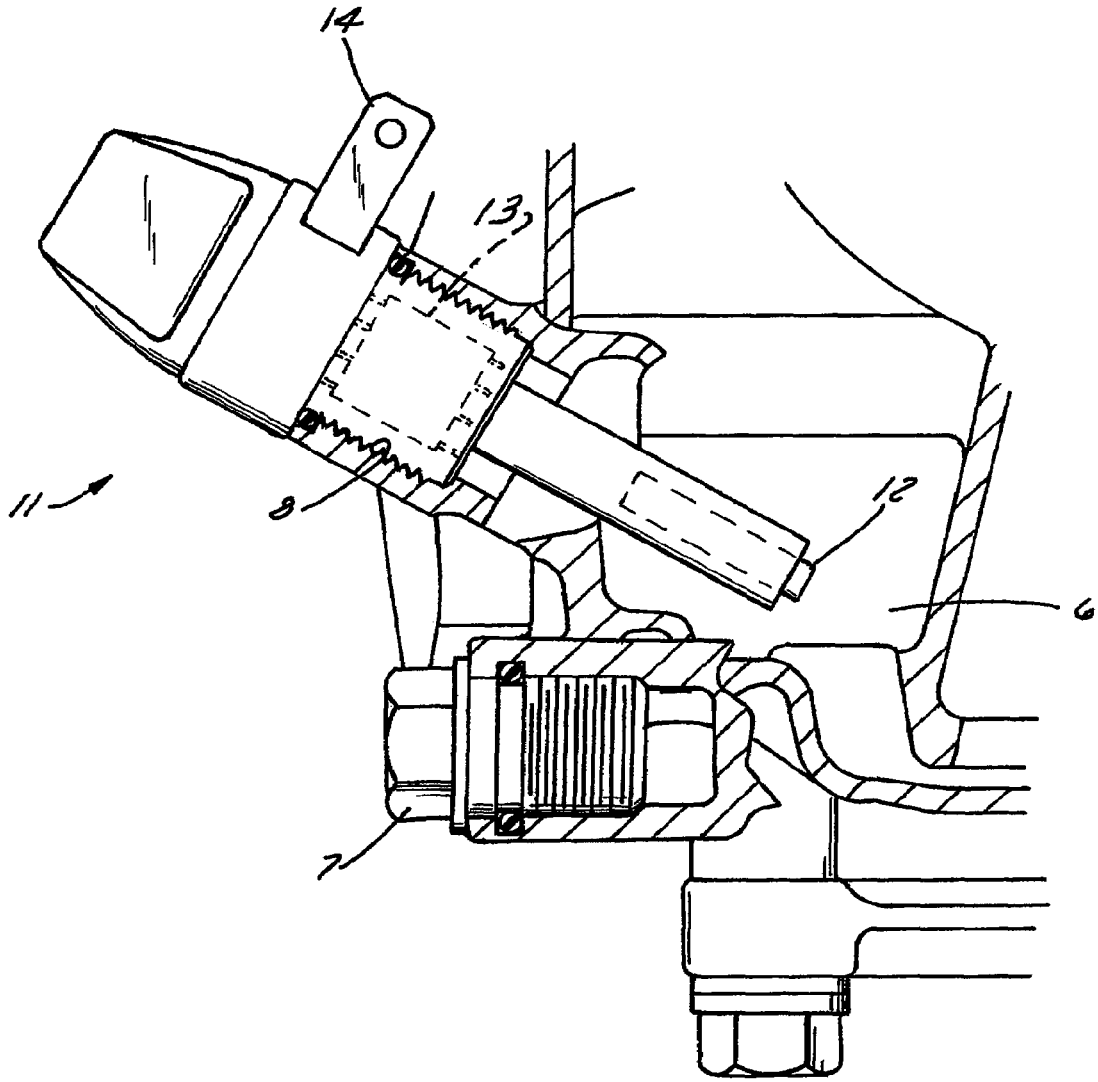
FIG. 2 a schematic representation of an oil monitoring system according to the invention.

FIG. 2 shows a cut-out section of FIG. 1 wherein the oil pressure switch 9 is replaced by an oil level monitoring device 11 according to the invention. The oil level monitoring device 11 comprises an oil measurement device 12 and an evaluation device 13.

In the example shown, the oil measurement device 12 comprises a sensor that operates according to a capacitive measurement principle. The sensor is positioned such that it is submerged in the oil when there is sufficient oil in the oil reservoir 6, thereby evaluating the oil as a dielectric material between two capacitor electrodes.

To this end, an oscillation cycle is energized, the frequency of which depends on whether the capacitor electrodes of the sensor are standing in the oil or not. The frequency is evaluated by a microprocessor that serves as an evaluation device 13 and is compared to prescribed frequency values so that an oil level reading can subsequently be obtained that indicates whether or not the sensor is sitting in oil (i.e.: a sufficient amount of oil or a lack of oil).

The power supply to the oil level monitoring device 11 is accomplished via a connection 14 to which a charging cable (shutoff cable, not shown) of a known alternator system located in the internal combustion engine can be connected. Since alternator systems are known in many forms, there is no need for further description thereof at this point. Instead of an alternator system, a battery ignition system can be used to operate the internal combustion engine as well as to feed power to the oil level monitoring device 11.

The connection 14 provides the ability for the oil level monitoring device 11 to shut off the internal combustion engine immediately or after a predetermined period of time expires when it is determined that a lack of oil exists. To accomplish this, the connection 14 is shorted to ground at the housing 1. If necessary, the oil level monitoring device 11 can also control the RPM of the engine through the connection 14 such that it only remains at idle RPM, for example.

Instead of the capacitive sensor, other physical measurement principles can be applied as well.

Especially advantageous is for the oil level in the oil reservoir 6 to be detected and evaluated when the engine is started so that the oil level monitoring device 11 can derive the required oil level reading at this earlier time point.

The oil level monitoring device 11 can of course also determine other information while the engine is running, since atomized or sprayed oil continues to drop onto the sensor of the oil measurement device 12, for example. If the engine is running dry or with a lack of lubrication, no more oil reaches the oil measurement device 12 so that even at this point the internal combustion engine can be shut down by the oil level monitoring device 11.

By suitably designing the oil measurement device 12 and the evaluation device 13, it is possible that the amount of oil can be measured and oil level information obtained right when the crankshaft is initially turned by the starter (reversing starter or electric starter) of the internal combustion engine. This prevents the subsequent turbulence of the oil in the oil reservoir 6 caused by the starting process from producing any measurement errors.

Thus, one can configure the system such that the oil level reading is obtained only once when the internal combustion engine is started, with subsequent oil level readings being ignored, particularly those reporting an apparent lack of oil. In the process, it is assumed that if the internal combustion engine contains sufficient oil when it is started, it also contains sufficient oil for the operating period thereafter. This is especially the case when the internal combustion engine is used in a working device with a relatively short operating period (for example less than one hour). Each time the engine is restarted, the oil level can be re-checked.

The fact that the oil level monitoring device 11 receives electrical energy from the power supply already contained within the internal combustion engine by means of the ignition system makes it unnecessary to provide an additional power supply. The oil level monitoring device 11 is thus powered on the one hand from the ignition system of the engine. On the other hand, it can shut down the engine via the ignition system.

Where the oil level monitoring device 11 is used in a diesel engine, a suitable system should be provided for the supply of energy, such as a battery or a generator to power the oil level monitoring device 11. Furthermore, the oil level monitoring device 11 can be coupled to a device to interrupt the supply of fuel (e.g. a solenoid valve).

If there is an amount of oil available at start that is considered sufficient, the oil level monitoring device 11 can remain inactive thereafter so that the engine runs uninfluenced by the oil level monitoring device 11. If desired, however, the oil level monitoring device 11 can continue to monitor the oil level and if necessary take action in extreme situations.

If the internal combustion engine is used to operate a vibration exciter in a working device such as a tamper, a hammer or a vibration plate for soil compaction, it is especially useful if the measurement of the oil level, i.e. the acquisition of the oil level reading, is done prior to activating the vibration exciter. It is at this time that the majority of the oil is still in the oil reservoir 6. However, after activating the vibration exciter, such strong vibrations are exerted that the oil can be distributed throughout the crankcase 10.

A conventional shutoff mechanism can also be used as an oil measurement device 12, such as a static oil switch, provided that it can stand up to the vibration. The evaluation device 13 should in this case be designed such that the oil level measurement only evaluates the measurement signals from the oil switch at the beginning of engine operation, i.e. when it is started—as illustrated above. The measurement signals from the oil switch should be ignored by the evaluation device 13 while the engine is running, in particular after the vibration exciter has been activated.

Figure 3:
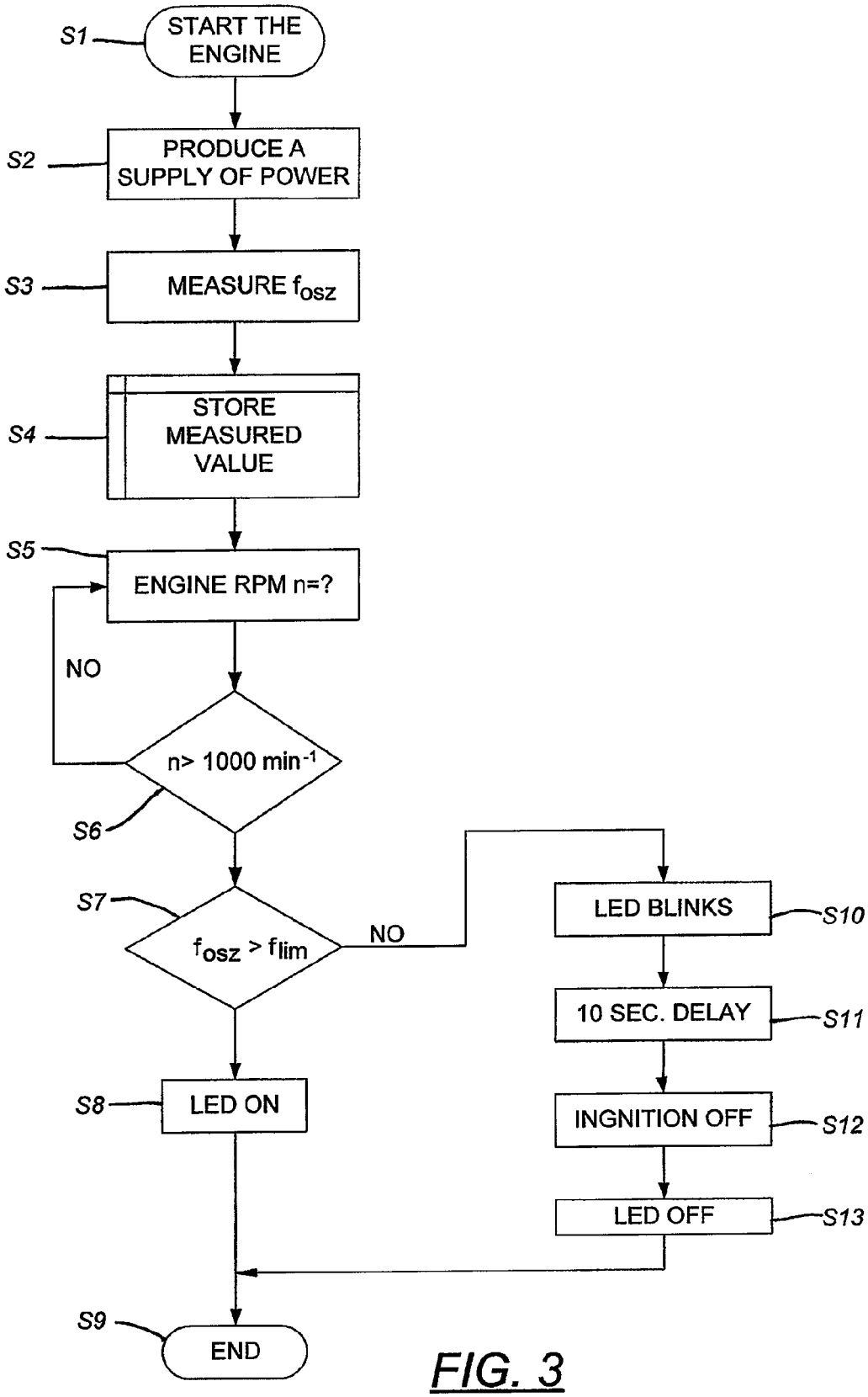
FIG. 3 a flow diagram to explain the oil monitoring system according to the invention.

In FIG. 3, a flow diagram is shown that illustrates the operating principle of the oil level monitoring system according to the invention.

In a step S1, the internal combustion engine is started, for example by pulling on a reversing starter.

This results in a supply of power in step S2 for the electronics used in the oil level monitoring device 11.

In step S3, a vibration frequency $f_{osz}$ of an oscillator circuit equipped with a microprocessor is measured using the capacitive sensor of the oil measurement device 12. The frequency $f_{osz}$ changes depending on the level of wetting of oil on the sensor. The measurement in step S3 can be performed right when the engine is started, i.e. right when the reversing starter is initially pulled. The data measured are then stored in step S4. The engine RPM is measured in step S5 and in step S6 compared to a prescribed value (here: 1000 $min^{-3}$). As long as the engine speed has not yet reached this prescribed speed, the PRM continues to be measured in step S5.

If the engine RPM has exceeded the prescribed limit RPM, step S7 examines whether the measured oscillator circuit frequency $f_{osz}$ is greater than a pre-set frequency $f_{lim}$. The pre-set frequency $f_{lim}$ is stored during production of the working device at the factory at the time the sensor is calibrated. The frequency $f_{lim}$ corresponds to the oscillating frequency for the minimum oil level required.

If the frequency measured $f_{osz}$ is greater than $f_{lim}$, an LED is turned on in step S8 for operational controls, and in step S9 the oil level monitoring system is turned off. The oil amount in the internal combustion engine is no longer monitored during the operating cycle. Only when the engine is restarted—after it has been turned off—does the oil level check begin again with step S1.

If it is determined in step S7 that the frequency $f_{osz}$ measured is less than the prescribed frequency limit $f_{lim}$, the system concludes that there is no longer enough oil in the internal combustion engine. Thereafter, an LED is caused to blink in step S10 in order to provide a warning to the operator. During this time, the engine continues to run. After a specific time period (e.g. 10 seconds, step S11), the ignition system of the internal combustion engine is shut down in step S12 so that the engine shuts off. The LED shuts off as a result in step S13. The operator can now add oil.

The invention claimed is:

1. A working device with an internal combustion engine and a vibration exciter, wherein the internal combustion engine comprises:

a starting device to start the internal combustion engine;

an oil reservoir near a crankcase to hold oil;

an oil measurement device to recognize that oil is present in the oil reservoir and to produce a corresponding signal; and an evaluation unit to produce a first oil level reading based on the signal from the oil measurement device;

wherein the first oil level reading is producible within a specified time period after the internal combustion engine is started;

the time period is determined such that it ends before the vibration exciter is caused to operate by the internal combustion engine; and wherein during a single operating period, if the first oil level reading indicates a sufficiently high oil level, the first oil level reading remains even after the end of the specified time period after start, despite a subsequent oil level reading indicating an insufficiently high oil level.

2. A working device according to claim 1, wherein the specified time period is short relative to an operating time of the internal combustion engine.

3. A working device according to claim 1, wherein the beginning point at which the vibration exciter is caused to operate constitutes the end of the specified time period.

4. A working device according to claim 2, wherein a coupling is provided to couple the internal combustion engine to the vibration exciter and that the oil level reading is produced by the evaluation unit after the start of the internal combustion engine until the coupling couples the internal combustion engine to the vibration exciter.

5. A working device according to claim 1, wherein the oil level reading can be produced up to the beginning of a work phase in which the working device performs its work for which it is intended.

6. A working device according to claim 1, wherein the oil level reading can be produced within a pre-determined period of time after reaching a predetermined minimum RPM of the internal combustion engine.

7. A working device according to claim 6, wherein the oil level reading can be produced immediately after reaching the predetermined minimum RPM of the internal combustion engine.

8. A working device according to claim 1, wherein the oil level reading can be produced as long as the actual crankshaft RPM is less than a prescribed working RPM.

9. A working device according to claim 1, wherein the oil level reading can be produced once.

10. A working device according to claim 1, wherein a stopping device to interrupt the operation of the internal combustion engine is provided;

the evaluation unit is coupled to the stopping device; and when a specific oil level reading exists, the operation of the internal combustion engine can be interrupted by the stopping device.

11. A working device according to claim 10, wherein the operation of the internal combustion engine can be interrupted by the stopping device after the expiration of a predetermined time period after the specific oil level reading is present.

12. A working device according to claim 1, wherein the evaluation unit is coupled to an RPM regulating unit, and wherein, when a specific oil level reading is present, the RPM of the internal combustion engine can be adjusted by the RPM regulating unit to an RPM value that is below an operating RPM.

13. A working device according to claim 1, wherein the evaluation unit is coupled to a display unit and wherein, when a specific oil level reading is present, a visual and/or acoustic display reading can be output via the display unit.

14. A working device according to claim 13, wherein the display reading can be output via the display device over a specific time period, even if the oil level reading is no longer present.

15. A working device according to claim 1, wherein the specific oil level reading corresponds to a reading indicating that too little oil exists in the oil reservoir.

16. A working device according to claim 1, wherein the oil level reading exists in the form of a signal.

17. A working device according to claim 1, wherein the internal combustion engine comprises a power supply unit to produce and/or store electrical energy;

a supply voltage can be provided by the power supply unit after the internal combustion engine is started, said voltage provided for the oil measurement device and the evaluation device;

the oil level reading can be produced by the evaluation unit for a short period of time immediately after the starting process of the internal combustion engine begins.

18. A working device according to claim 1, wherein the internal combustion engine comprises a power supply unit to store electrical energy;

a supply voltage can be provided by the power supply unit before the internal combustion engine is started, said voltage provided for the oil measurement device and the evaluation device;

the oil level reading can be produced by the evaluation unit for a short period of time immediately before the starting process of the internal combustion engine begins;

the oil level reading can be stored.

19. A working device according to claim 1, wherein the evaluation unit is integrated into the oil measurement unit.

20. A working device according to claim 1, wherein the oil measurement unit includes an oil sensor.

21. A working device according to claim 20, wherein the oil sensor operates according to a capacitive, optical, thermal and/or mechanical principle.

22. A working device according to claim 20, wherein the internal combustion engine comprises an engine housing and that the oil sensor can be screwed into a threaded socket in the engine housing.

23. A method of monitoring an oil level in an internal combustion engine to operate a vibration exciter in a working device, wherein the internal combustion engine includes:

a starting device to start the internal combustion engine;

an oil reservoir near a crankcase to hold oil, wherein the oil is distributed from the oil reservoir to the crankcase without an oil pump;

an oil measurement device to recognize that oil is present in the oil reservoir and to produce a corresponding signal; and an evaluation unit to produce oil level readings based on the signal from the oil measurement device;

that method comprising the steps of starting the internal combustion engine using the starting device;

operating the oil measurement device immediately after the starting procedure of the internal combustion engine is begun up to the point at which the vibration exciter is activated to recognize the presence of oil in the oil reservoir and to produce the corresponding signal; and evaluating the signal to produce an oil level reading.

24. A method of monitoring an oil level in an internal combustion engine to operate a vibration exciter in a working device, wherein the internal combustion engine includes:

a starting device to start the internal combustion engine;

an oil reservoir near a crankcase to hold oil, wherein the oil is distributed from the oil reservoir to the crankcase without an oil pump;

an oil measurement device to recognize that oil is present in the oil reservoir and to produce a corresponding signal; and an evaluation unit to produce oil level readings based on the signal from the oil measurement device;

that method comprising the steps of starting the internal combustion engine using the starting device;

operating the oil measurement device immediately after the starting procedure of the internal combustion engine is begun to recognize the presence of oil in the oil reservoir and to produce the corresponding signal;

evaluating the signal to produce an oil level reading, wherein the oil level reading is only produced after a predetermined minimum RPM of the internal combustion engine is reached.

25. A method according to claim 23, wherein the oil level reading is produced only once for each start process.

26. A method according to claim 23, wherein a specific oil level reading corresponds to an indication that too little oil exists in the oil reservoir and wherein, that based on the specific oil level reading, at least one of the following actions is initiated:

immediate interruption of the operation of the internal combustion engine;

interruption of operation of the internal combustion engine after a prescribed time period has passed after establishing the specific oil level reading;

limiting of the RPM of the internal combustion engine to an RPM value that is below an operating RPM;

activation of an acoustic and/or visual display.

27. A ground compaction machine for compacting soil, comprising:

a vibration exciter that can be driven to compact soil; and an internal combustion engine that drives the vibration exciter, the internal combustion engine including a crankcase, an oil reservoir near the crankcase, an oil measurement device that generates signals indicative of an oil level in the oil reservoir, and a microprocessor-based evaluation circuit that receives signals from the oil measurement device and that evaluates the signals during an engine starting process, the evaluation circuit interrupting operation of the engine if a low oil level condition is detected during the engine starting process and otherwise permitting the engine to run, even if a low oil level condition is detected during post-starting engine operation.

28. The ground compaction machine according to claim 27, wherein, if a low oil level condition is detected during the engine starting process, the evaluation circuit interrupts operation of the engine prior to termination of the engine starting process such that the engine does not run.

29. The ground compaction machine according to 27 wherein, if a low oil level condition is detected during the engine starting process, the evaluation circuit permits the engine to run for a specified period of time and thereafter interrupts operation of the engine.

30. A method of operating a ground compaction machine, the machine including a vibration exciter that can be driven to compact soil and an internal combustion engine that drives the vibration exciter, the method comprising:

turning a crankshaft of the engine to initiate an engine starting process;

during the engine starting process, detecting an oil level in an oil reservoir of the engine; and using a microprocessor based evaluation circuit, interrupting operation of the engine if a low oil level condition is detected during the engine starting process and otherwise permitting the engine to run and drive the vibration exciter, even if a low oil level condition is detected during post-starting engine operation.

31. The method according to claim 30, wherein the interrupting step is performed prior to termination of the engine starting process such that the engine does not run.

32. The method according to claim 30, wherein the interrupting step is performed a specified time period after the end of the engine starting process.

33. A working device according to claim 1, wherein the specified time period extends between (i) a first time at which an ignition of the internal combustion engine generates energy, and (ii) a second time at which the vibration exciter is energized.

34. A working device according to claim 1, wherein oil level readings are producible during an entire operational RPM range of the internal combustion engine and cease when the vibration exciter is energized.

35. A working device according to claim 1, wherein at least one of the oil measurement device and the evaluation unit is powered by an ignition of the internal combustion engine.

* * * * *